US005183190A

United States Patent [19]

Zuckerman

[11] Patent Number: 5,183,190

[45] Date of Patent: Feb. 2, 1993

[54] FOLDABLE GARMENT DISPLAY HANGER

[75] Inventor: Andrew M. Zuckerman, Forest Hills, N.Y.

[73] Assignee: Different Dimensions, Inc., Rego Park, N.Y.

[21] Appl. No.: 798,499

[22] Filed: Nov. 26, 1991

[51] Int. Cl.[5] ..... A47G 25/48; A47G 25/28

[52] U.S. Cl. ..... 223/96; 223/89; 223/DIG. 4

[58] Field of Search ..... 223/94, 89, DIG. 4, 223/DIG. 3, 85, 87, 88, 96, 92, 95; 211/113; D6/326, 315, 323, 324

[56] References Cited

U.S. PATENT DOCUMENTS

| | | | |
|---|---|---|---|
| 1,058,394 | 4/1913 | Wahl | 223/94 X |
| 1,278,054 | 9/1918 | Strand | 223/89 |
| 1,760,352 | 5/1930 | Feigelman | 223/92 X |
| 3,487,984 | 1/1970 | Loscalzo et al. | 223/96 |
| 3,870,206 | 3/1975 | Feinberg | 223/88 |
| 3,966,100 | 6/1976 | Nelson | 223/92 |
| 4,186,858 | 2/1980 | Tatematsu | 223/94 |
| 4,227,632 | 10/1980 | Collis | 223/94 |
| 4,565,309 | 1/1986 | Batts et al. | 223/96 |
| 4,813,581 | 3/1989 | LaMont | 223/94 |
| 4,889,265 | 12/1989 | Morgan | 223/96 |
| 4,932,571 | 6/1990 | Blanchard | 223/89 |
| 4,988,021 | 1/1991 | Adams et al. | 223/88 X |
| 5,022,570 | 6/1991 | Watford | 223/85 X |

FOREIGN PATENT DOCUMENTS

| | | | |
|---|---|---|---|
| 128362 | 6/1946 | Australia | 223/88 |
| 1119387 | 7/1968 | United Kingdom | 223/88 |

*Primary Examiner*—Werner H. Schoroeder
*Assistant Examiner*—Bibhu Mohanty
*Attorney, Agent, or Firm*—Amster, Rothstein & Ebenstein

[57] ABSTRACT

A foldable garment hanger capable of being attached to and folded with a garment and then boxed, if necessary, and shipped with the garment in a minimum of space so that the hanger needs merely to be unfolded with the garment and hung upon arrival at the retail store. The hanger is comprised of a hanger body, a suspension member and two arms, each with garment retaining means at its end. The arms are connected by a living hinge that enables the arms to be folded toward each other. The suspension member possesses latching means and is connected to the body by a hinge that enables the suspension member to be folded along the hinge and latched to the body arms for support in hanging of the hanger.

15 Claims, 4 Drawing Sheets

FIG. 9
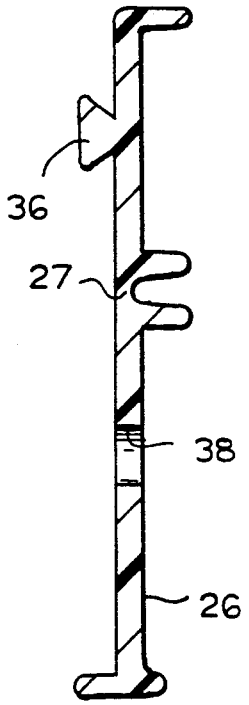
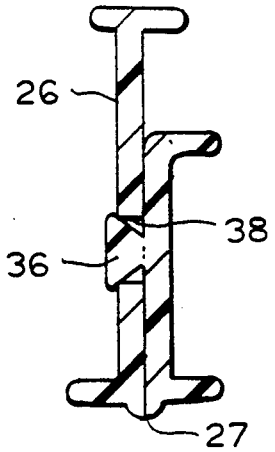
FIG. 10
FIG. 11
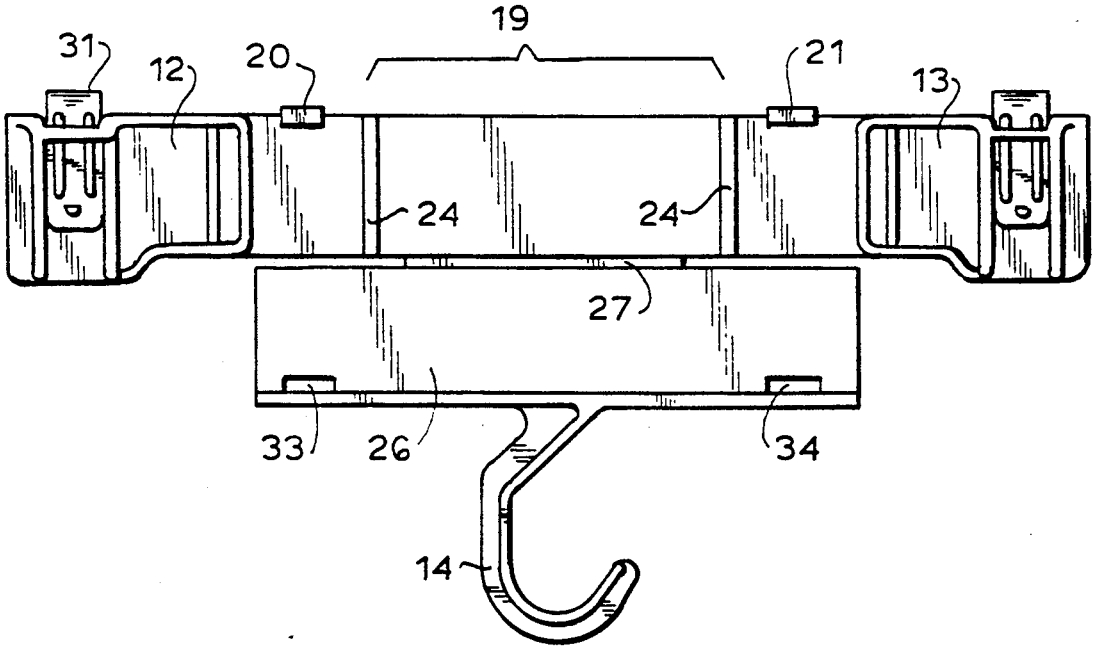

FOLDABLE GARMENT DISPLAY HANGER

BACKGROUND OF THE INVENTION

This invention relates to garment hangers which are primarily used to ship clothing from the manufacturer to the retailer. More particularly, this invention relates to garment hangers for garments of the type that could be folded or boxed and shipped unhung to retail stores.

Garments that are to be displayed hanging at the retail store may be shipped folded and boxed from the manufacturer to the retailer. This process usually involves the extra time and labor of applying hangers to the garments at the retail store prior to display. It is desirable to provide garment hangers that allow the garments to be prehung by the manufacturer so that the garments may be immediately hung and displayed upon arrival at the retail store, thereby avoiding the extra time and labor of applying hangers to the garments.

One prior method for shipping prehung garments, disclosed in U.S. Pat. No. 4,565,309, involves first draping the garment over the lower of two jaw-like horizontal bars joined at one end by a hinge and then clamping the upper horizontal bar down over the garment onto the lower bar by means of a clamp at the opposite end. Another method, disclosed in U.S. Pat. No. 4,889,265, involves first draping the garment over a lower horizontal bar and then clamping the garment to the parallel upper horizontal bar by folding the lower bar up and latching it at both ends to the upper bar. In both of these cases, a hanger hook is rigidly connected to the upper of the two horizontal bars to allow hanging of the prehung garments immediately after shipping.

Although these prior devices allow the garment to be shipped prehung and allow the hanger and garment to be hung immediately after shipping, the width of the hanger body and the protrusion of the hook occupy valuable shipping space. It is desirable to provide a garment hanger that would allow the garment to be shipped prehung, while itself occupying only a minimum of space during shipping.

The hangers disclosed in U.S. Pat. Nos. 3,870,206 and 4,932,571 avoid the problem caused by the hook's protrusion by providing hooks that fold down when the hanger is not in hanging use. The hanger disclosed in U.S. Pat. No. 3,870,206 allows the hinged hook to fold down and fit within the hanger body. U.S. Pat. No. 4,932,571 allows the hook and other parts of the hanger frame to fold inside an outer frame for storage of the hanger when not in use. These hanger devices are also not suitable for shipping because, even though their hooks no longer protrude, their width and, in the case of U.S. Pat. No. 4,932,571, height still occupy valuable shipping space. Moreover, neither of these hangers provides any means for securing a garment during shipping.

Additionally, none of these prior devices works for garments that are not simply draped over a horizontal bar but require additional folding or boxing as well. Because these devices provide, at most, horizontal bars which are clamped to each other, any garment that is not simply draped over a horizontal bar, but requires folding or boxing rather than hanging or in addition to hanging, may not be shipped using these prior devices.

It is desirable to provide a foldable garment hanger that could be attached to the garment, folded along with the garment and, if necessary, boxed for shipping along with the garment. Alternatively, it is desirable to provide a garment hanger that could be attached to the pre-folded garment and then, if necessary, boxed for shipping along with the garment. The advantage of this foldable hanger is that the hanger would need only to be unfolded with the garment and then hung in order to be displayed. This would save the time and labor ordinarily spent in applying hangers to the garments.

SUMMARY OF THE INVENTION

This invention provides a molded plastic one-piece garment hanger including a substantially rigid hook and two substantially rigid horizontal body arms. Each arm has garment retaining means at its end. The hook is connected by its collar to one of the body arms via a living hinge that allows the hook to fold up along an axis of rotation parallel to and in the plane of the body arms in their open position.

The two body arms are connected via a living hinge which allows the two arms to fold together along an axis of rotation substantially perpendicular to the arms in the plane of the hanger. This allows the hanger to be folded for shipping along with the garment. By then folding the hook down alongside the folded grasped garment, the hanger is able to fit with the garment in a shipping container. Due to the compact shape of the folded hanger, the hanger folded within the garment will occupy little, if any, additional space in the shipping container.

Each arm possesses at its base near the hanger body living hinge protruding stud members that latch into corresponding openings on the hook collar. These stud members lock the hanger arms in the open position when the hook folds up. This latching action allows the hanger to be hung with the attached garment. These latches can be made so that they do not lock permanently in order that the hanger may be unfolded and used again for shipping.

It is accordingly an object of this invention to provide a garment hanger that may be attached to the garment and then folded or boxed with the garment prior to shipping so as to be immediately hung by the retailer.

It is another object of this invention to provide a garment hanger that may be attached to a folded garment and then boxed with the folded garment prior to shipping so as to be immediately hung by the retailer.

It is still another object of this invention to provide a garment hanger that may be shipped while attached to the garment and while folded or boxed with the garment without itself occupying much space.

BRIEF DESCRIPTION OF THE DRAWINGS

FIG. 9 is a cross-sectional view of an alternative embodiment of the latching mechanism and the hook collar living hinge taken along the plane of line 9—9 in FIG. 8.

FIG. 10 is a cross-sectional view of the engaged alternative latching mechanism embodiment.

FIG. 11 is a side elevational view of the hanger in its fully open position under an alternative embodiment of the hanger body living hinge.

DETAILED DESCRIPTION OF THE PREFERRED EMBODIMENTS

Figure 1:
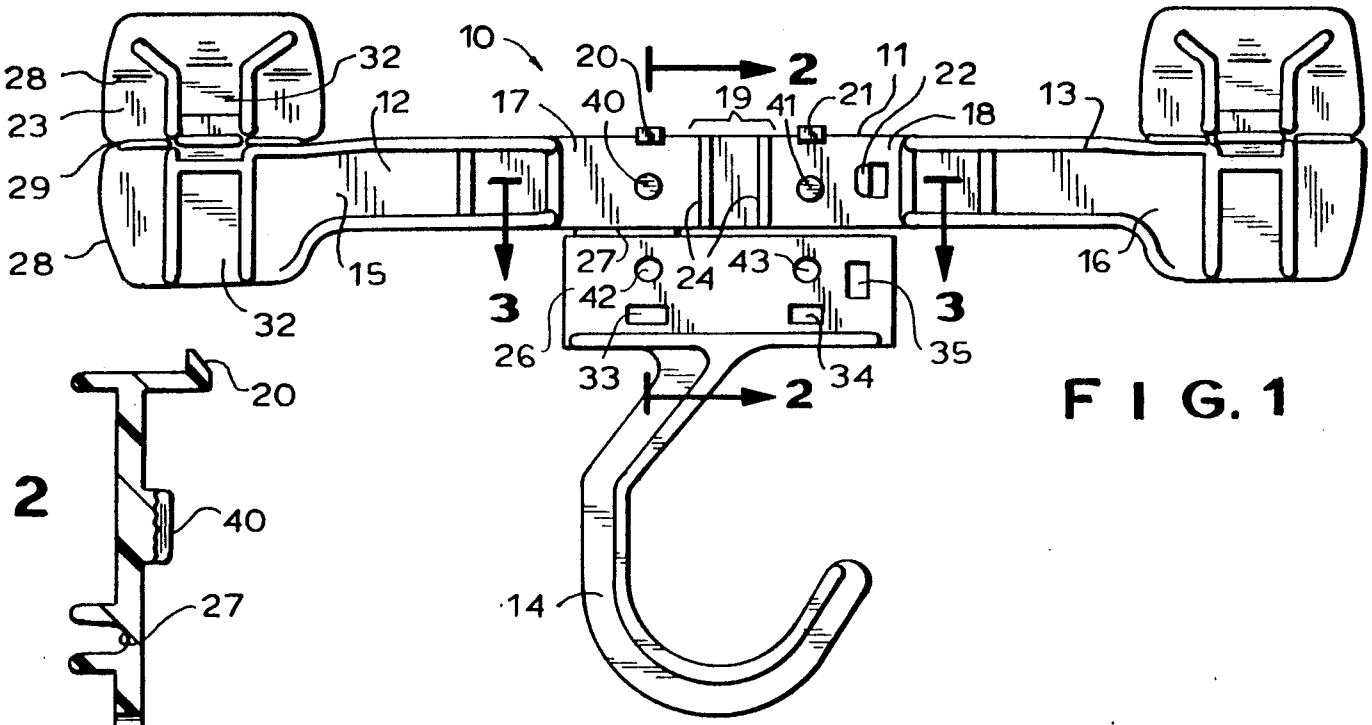
FIG. 1 is a side elevational view of the garment hanger of the present invention in its fully open position.

Referring to the drawings, FIG. 1 illustrates a foldable garment display hanger 10 of the present invention in its fully open position. The hanger has an elongate and preferably planar body 11 composed of two extended body arms 12, 13 and a hanging means such as a hook 14 preferably, though not necessarily, at its center for supporting the hanger 10. The entire hanger structure may be formed of any suitable injection-moldable material, such as plastic, preferably as a one-piece integral structure.

Each of the two extended body arms 12, 13 has a free end 15, 16 and a base portion 17, 18 and is connected to the other arm at its respective base via a living hinge 19. Each of the body arms should preferably have the cross-sectional shape roughly of an I-beam to give the arm the rigidity needed when pulled in the plane of the hanger by the weight of the garment. Each arm should preferably have upper and lower flanges that should be joined preferably by at least one intermediate vertical transverse web strut for added strength. Each body arm has an integrally molded garment retaining means 23 at its end.

Figure 3:
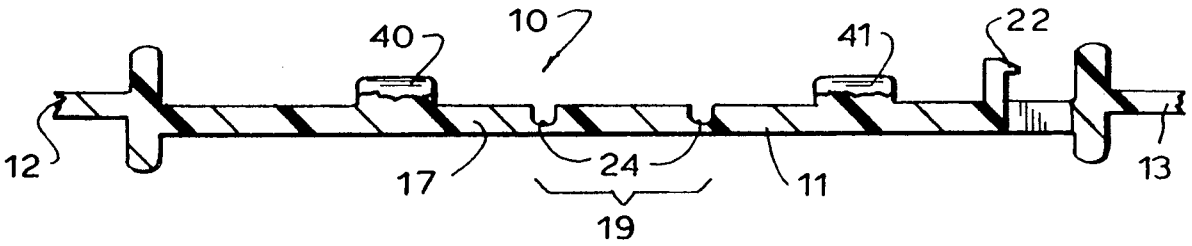
FIG. 3 is a fragmented cross-sectional view of the preferred embodiment of the hanger body living hinge taken along the plane of line 3—3 in FIG. 1.

The living hinge 19 divides the hanger body 11, preferably, though not necessarily, at its approximate midpoint into the two body arms 12, 13. In a preferred embodiment, the living hinge 19 comprises two closely spaced hinges 24 which lie along two substantially parallel axes in the plane of the fully open hanger body 11. These hinges are formed by known means in the art, such that the hinges 24 are made of the same material as the body arms 12, 13 but are made substantially thinner in order to facilitate flexing when the body arms 12, 13 are folded along the hinges 24. FIG. 3 illustrates the reduced material thickness of the hinges 24 that together form the living hinge 19.

An alternative embodiment is one in which the living hinge 19 comprises only one hinge, formed by known means as described above. This embodiment, however, is less desirable since it might not allow sufficient space between the folded body arms near the hinge 19 to fit the garment that has been folded with the body arms.

Alternatively, the living hinge 19 may comprise two hinges 24 as in the preferred embodiment that are not closely spaced, but rather are spaced farther apart (FIG. 11). This embodiment allows a garment and its attached hanger to be folded into three sections rather than two. The advantage of this embodiment is that it allows for a three-section fold pattern that may be more appropriate for a particular garment than a two-section fold pattern.

Referring again to FIG. 1, the hanging means 14 is typically a hook but may be any other suitable suspension apparatus, such as a ring. The hook 14 extends into a widened collar 26 for support. The hook collar 26 is connected to the hanger body 11 via a living hinge 27 that extends along the edge of the hook collar 26 opposite the hook 14 and attaches the hook collar 26 to the hanger body 11 along the lower edge of the base 17 of only one hanger body arm 12. The result is that part of the hook collar 26 extends past the hanger body living hinge 19 alongside the other body arm 13.

In the preferred embodiment, the living hinge 27 extends along not more than half the hook collar 26 along the edge opposite the hook 14. In this embodiment, when the hook collar 26 is folded up and latched to the hanger arms 12, 13 in their open position, the hanger arms are secured in their open position and are prevented from folding together. Alternatively, the living hinge 27 may extend along more than half the hook collar 26 leaving the remaining unhinged section of the hook collar 26 to latch to the unattached body arm 13. Although less rigid, this embodiment may be more desirable for reasons relating to the particularities of the garment.

Another alternative embodiment of the hook collar living hinge 27 is one in which the hook collar 26 is connected to the hanger body 11 via a living hinge 27 that extends along the full width of the hook collar 26 and attaches the hook collar 26 to both hanger arms 12, 13. In this embodiment, the hanger body living hinge 19 would extend down, across the hook collar living hinge 27, across the hook collar 26 to allow the hook collar to fold along this hinge 19 when the body arms are folded together in FIG. 2.

Note that in the previously described third embodiment of the hanger body living hinge 19 (FIG. 11) wherein the two hinges 24 are widely spaced, the hook collar 26 must be wider than in the first two hanger body living hinge embodiments in order to extend past the two hinges 24 alongside the unattached body arms 12, 13 so as to be able to latch onto each unattached body arm 12, 13.

Figure 2:
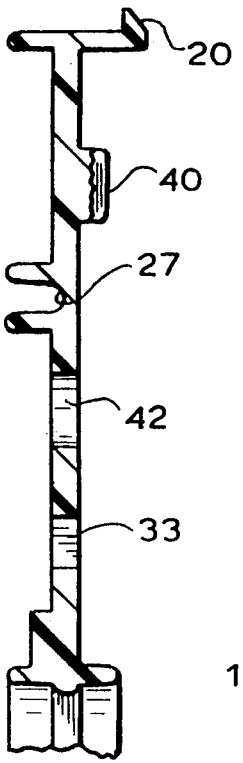
FIG. 2 is a cross-sectional view of the preferred embodiment of the latching mechanism and the hook collar living hinge taken along the plane of line 2—2 in FIG. 1.

The hinge 27 is formed by known means in the art. As with the hanger body hinge 19, this hinge 27 is made of the same material as the body arms 12, 13 and hook 14 but is made substantially thinner in order to facilitate flexing when the hook collar 26 is folded alongside the body arms 12, 13 for hanging and for shipping. FIG. 2 illustrates the reduced material thickness of this living hinge 27.

The garment retaining means 23 may be any of those in the prior art suitable for attachment of all types of garments, whether to be hung or folded. A clamp 23, shown open in FIG. 1, is one form of retaining means that may be used to secure the garments properly during shipping and during display hanging. In one embodiment, shown closed in FIGS. 4 and 5, the clamp may have a pair of jaws 28 joined by a thin, flexible hinge 29. The inner edges of the jaw ends are preferably molded with grooves or teeth 30 to engage and grip the garment between them. The jaws 28 are secured together by a folded strip 31 that slides tightly into slots 32 (see FIG. 1) on the outer surface of the jaws when the jaws are closed. This strip 31 may be metal, plastic or any other suitable rigid material.

Figure 6:
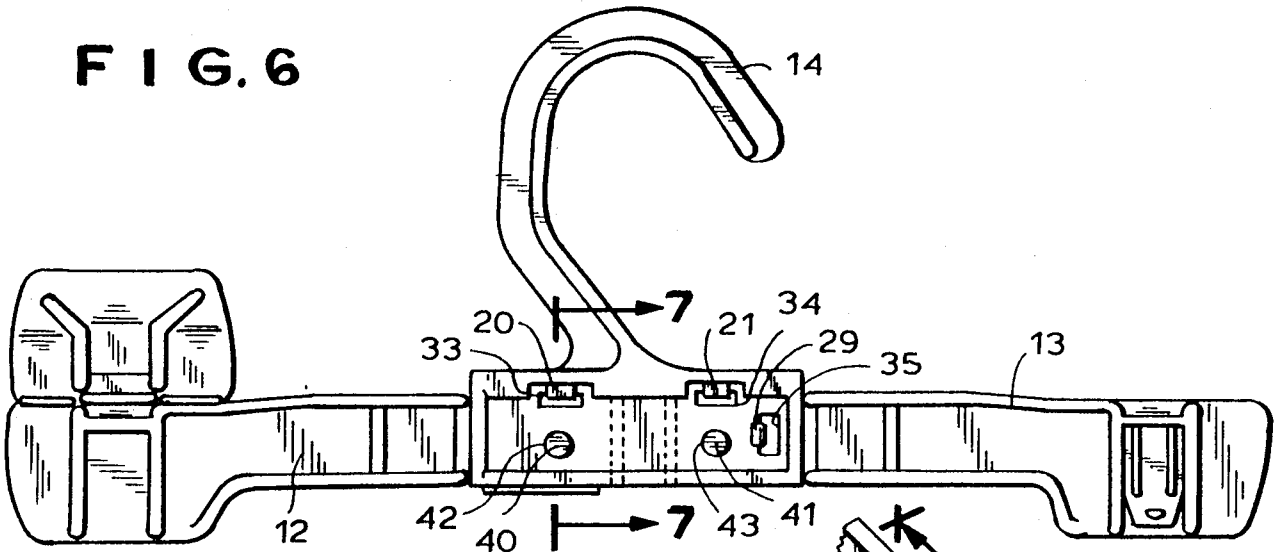
FIG. 6 is a side elevational view of the hanger with the hook folded up and the arms locked in their open position.

When used in a retail store to display garments, the hanger 10 will normally be used in the partially-folded hanging position illustrated in FIG. 6. Referring again to FIG. 1, the hook 14 must be folded up alongside the hook collar living hinge 27 and secured to the hanger body 11. For use in securing the hook 14 to the hanger body 11, each body arm 12, 13 possesses at its base 17, 18 close to the hanger body living hinge 19 at least one protruding latching means member 20, 21, 22 to latch into a corresponding opening or aperture 33, 34, 35 in the hook collar 26. The hook collar 26 possesses these latching means openings 33, 34, 35 at both ends of the collar 26, positioned to cooperate with the protruding members 20, 21, 22.

Thus, in the hanging position, as illustrated in FIG. 6, the hook collar 26 covers the bases 17, 18 of the body arms so that any protruding latching members 20, 21, 22 on the body arms 12, 13 latch into the openings 33, 34, 35 in the hook collar 26. The hook collar 26 extends along each hanger arm 12, 13 when folded up via living hinge 27 and latched to the hanger body 11. This latching means serves to lock the hook collar 26 to the hanger arms 12, 13 in their open position so as to provide support for both the hook 14 and the hanger body 11 when the hanger and garment are hung.

Figure 7:
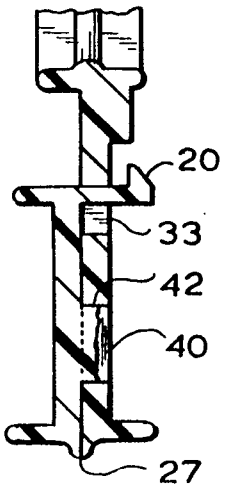
FIG. 7 is a cross-sectional view of the engaged latching mechanism taken along the plane of line 7—7 in FIG. 6.

One embodiment of this latching means is illustrated in FIGS. 2 and 7. Here, the protruding latching members are stud members 20, 21, 22 that are widened protrusions, each of an inverted cross-sectional L-shape, which snap through and latch onto the edges of the respective corresponding openings 33, 34, 35 in the hook collar 26.

In one arrangement of latching means within this embodiment, the stud members 20, 21 are positioned horizontally at the upper edges of the body arm bases 17, 18. The corresponding openings 33, 34 are also positioned horizontally at the hook collar edges opposite the hinge 27 so as to cooperate with stud member 20, 21. This orientation gives the latching means latching strength about the horizontal axis of the hook collar living hinge 27.

In an alternative arrangement of latching means within this embodiment, protruding stud member 22 is positioned vertically, in an orientation transverse to and at a 90° clockwise rotation from the orientation of stud members 20, 21 as illustrated in FIG. 1, at the side edge of the arm base area 18 of the body arm 13 unconnected by the hook collar living hinge 27 to the hook collar 26. The corresponding opening 35 is also positioned vertically on the hook collar side edge so as to cooperate with stud member 22. This orientation and position adds latching strength about the vertical axis of the hanger body living hinge 19 by preventing the body arm 13, which is not connected to the hook collar 26 by the living hinge 27, from folding backward toward the other body arm 12 when the hanger is in its hanging position of FIG. 6.

In the preferred embodiment, this vertical latching member 22 should be present on the garment hanger 10 along with horizontal latching members 20, 21 for maximum latching strength and support of the hanger in its hanging position. However, the latching mechanism will function without the vertical latching member 22. Alternatively, the latching mechanism will function if the vertical latching member 22 and only one horizontal latching member are present.

Figure 8:
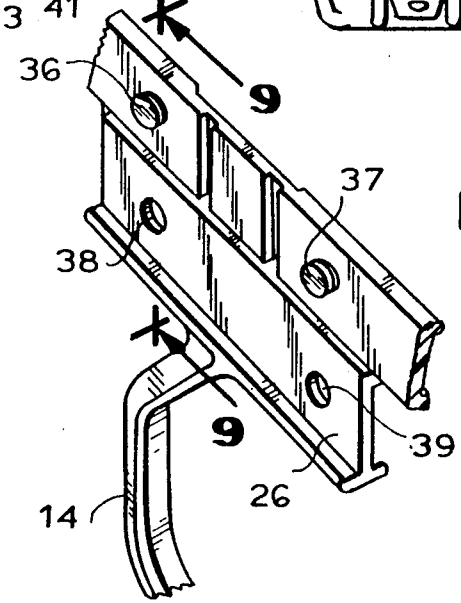
FIG. 8 is a fragmented top side end perspective view of an alternative embodiment of the latching mechanism.

In an alternative embodiment of the latching means, shown in FIGS. 8 and 9, the protruding latching members are pegs 36, 37 which taper out from the hanger arm bases 17, 18 so that their top edges are of greater diameter than their bottoms attached to the hanger arm bases. These pegs then snap into corresponding openings 38, 39 in the hook collar 26 to secure the hanger (FIG. 10).

For further use in securing the hook collar 26 to the hanger body 11, each body arm 12, 13 may possess at its base 17, 18 close to the hanger body living hinge 19 at least one protruding guiding means member 40, 41 to fit into a corresponding opening in the hook collar 42, 43. The hook collar possesses these guiding means openings 42, 43 positioned to cooperate with the protruding guiding means members 40, 41.

One embodiment of the guiding means is illustrated in FIG. 1. Here the protruding guiding means members 40, 41 are cylindrical pegs at the base 17, 18 of each body arm 12, 13 that fit through the round guiding means openings 42, 43 in the hook collar 26. The diameters of the protruding members 40, 41 are slightly smaller than those of the corresponding openings 42, 43 in order to allow the protruding members 40, 41 to fit through the corresponding openings 42, 43.

Figure 4:
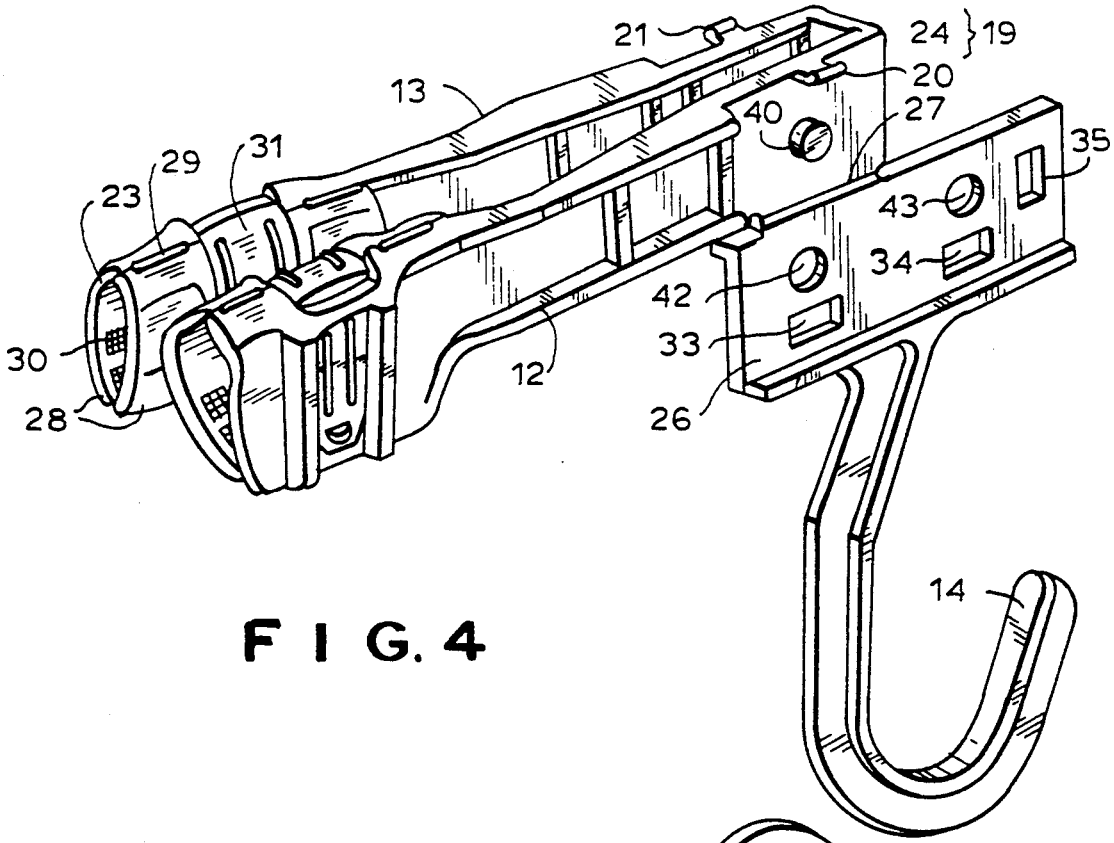
FIG. 4 is a side elevational top end perspective view of the hanger with the two body arms folded together.
Figure 5:
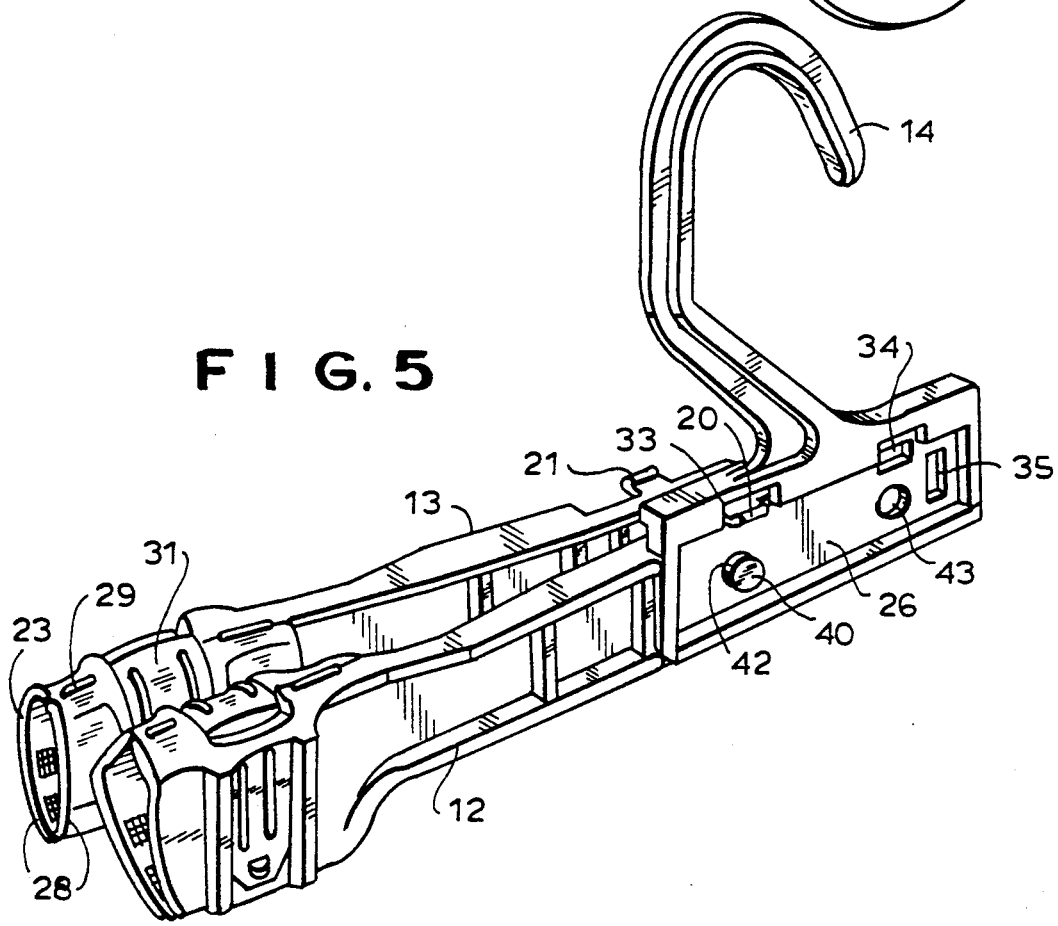
FIG. 5 is a side elevational top end perspective view of the hanger with the two body arms folded together and the hook folded up alongside the folded arms.

When used for shipping, the garment hanger 10 is changed from its fully open position (FIG. 1) into its shipping position by folding the hanger body arms 12, 13 together along living hinge 19 as illustrated in FIG. 4. If the hanger 10 was in its hanging position (FIG. 6), the resulting intermediate configuration is as illustrated in FIG. 4. The hook 14 and hook collar 26 are then folded down along living hinge 27 in order not to protrude during shipping. Alternatively, from the hanging position, first the hook 14 and hook collar 26 are folded down along living hinge 27 and then the hanger body arms 12, 13 are folded together along living hinge 19.

The hanger may be applied to the garment prior to folding and then folded for shipping with the garment or it may be folded and applied to an already folded garment. As mentioned earlier, the space formed between the hanger arms 12, 13 when the hanger body 11 is folded along the two hinges 24 which compose the living hinge 19 in the preferred embodiment allows for the garment grasped by the garment retaining means 23 to be folded with the hanger 10.

As shown in FIG. 4, folding down the hook 14 while the hanger body 11 is already folded with the garment compacts the shape of the hanger for shipping. This fold allows the hook to be "hidden" alongside the garment grasped by retaining means 23, thereby saving valuable shipping space by not protruding. At the same time, as FIG. 5 also illustrates, the hook collar 26 may be latched to the hanger arm 12 by cooperation of the protruding stud member 20 on the hanger arm 12 with the corresponding aperture 33 on the hook collar 26. Since the other hanger arm 13 is folded back in the position of FIG. 5, the protruding stud members 21, 22 on that other hanger arm 13 remains unlatched to their corresponding apertures 34, 35 on the hook collar 26.

Having described and illustrated a preferred embodiment and several modifications thereof, it will be understood by those skilled in the art that other modifications may be made without departing from the principles of the invention. Such modifications are to be considered as included in the appended claims unless these claims, by their language, expressly state otherwise.

I claim:

1. A foldable garment hanger, comprising:

(a) a body and a hanging means, said body having a length along a generally horizontal axis when said hanger is suspended by said hanging means;

(b) said body comprising two substantially rigid extended body arms, each arm having a free end and a base, each arm having retaining means adjacent its free end for securing garments during both shipping and display, and each arm constituting a portion of said length of said body, said body arms being connected one to another at their respective bases by a living hinge, so that said body arms may be folded together and positioned in side-by-side relation to decrease said length of said body;

(c) said hanging means comprising a suspension member and a widened collar, said collar being attached to the lower edge of one of said body arms adjacent to said hanger body living hinge, along the edge of said collar opposite said suspension member, this attachment being via another living hinge so that said suspension member and collar may be folded, inverted and positioned in side-by-side relation to said attached body arm or body arms; and (d) latching means for securing said suspension member and collar to said hanger body when said suspension member and collar are folded about said suspension member living hinge, for use in display hanging.

2. The hanger of claim 1 wherein the suspension member is a hook.

3. The hanger of claim 1 wherein said suspension member, suspension member collar, body arms, living hinges and garment retaining means are all molded as single unitary element.

4. The hanger of claim 1 wherein said suspension member collar is attached to both said body arms via said suspension member living hinge along entire width of suspension member collar, and hanger body living hinge extends across suspension member collar, so that suspension member collar may fold with body arms when body arms are folded for shipping.

5. The hanger of claim 1 which further comprises a second living hinge connecting one of said body arms to said first living hinge, so as to permit a space to exist between said bases of said body arms when said body arms are folded together along both said hinges, in which space a garment secured by said garment retaining means may fit during shipping.

6. The hanger of claim 1 which further comprises a second living hinge connecting one of said body arms to said first living hinge, said hinges being widely-spaced substantially parallel hinges, so as to permit the garment hanger to be folded into three sections.

7. The hanger of claim 1 wherein said latching means comprises one or more widened members protruding outward from said front faces of bases of body arms, each of an inverted cross-sectional L-shape with a supporting leg and a head portion extending from top of said leg portion, and one or more corresponding openings in said suspension member collar, which both cooperate to allow said L-shaped member to pass through said corresponding opening and allow said head portion of said L-shaped member to rest on the outer edge of said opening.

8. The hanger of claim 7 wherein said latching means comprises one or more inverted L-shaped stud members positioned along the direction of the axis of the suspension member living hinge.

9. The hanger of claim 7 wherein said latching means comprises one or more inverted L-shaped stud members positioned along the direction of the axis of the hanger body living hinge.

10. The hanger of claim 1 wherein said latching means comprises one or more peg members protruding outward from said front faces of bases of body arms, each tapered studs with top end diameters larger than attached end diameters, and one or more corresponding openings in said suspension member collar, said openings having diameters slightly smaller than diameters of top ends of said pegs, which both cooperate to permit said pegs to be forced through said corresponding openings and to remain there securely.

11. The hanger of claim 1 which further comprises guiding means for further use in securing said suspension member and collar to said hanger body, said guiding means comprising one or more peg members protruding outward from said front faces of bases of body arms and one or more corresponding openings in said suspension member collar, said openings having diameters slightly larger than diameters of said pegs, which both cooperate to permit said pegs to fit through said corresponding openings.

12. A foldable garment hanger, comprising:

(a) a body and a hanging means, said body having a length along a generally horizontal axis when said hanger is suspended by said hanging means;

(b) said body comprising two substantially rigid extended body arms, each having a free end and a base, and each constituting a portion of said length of said body, said body arms connected one to another at their respective bases by a first hinge and a second hinge, so that said body arms may be folded together and positioned in side-by-side relation to decrease said length of said body, said first hinge connecting one of said body arms to a spacer and said second hinge connecting the other of said body arms to said spacer so as to permit a space to exist between said bases of said body arms when said body arms are folded together along both said hinges;

(c) said hanging means comprising a suspension member and a widened collar, said collar attached to one of said body arms, this attachment being via another hinge so that said suspension member and collar may be positioned in side-by-side relation to said body arms; and (d) latching means for securing said suspension member and collar to said hanger body when said suspension member and collar are in side-by-side relation to said body arms.

13. The hanger of claim 12 wherein each of said body arms have retaining means at its free end for securing garments.

14. A foldable garment hanger, comprising:

(a) a body and a hanging means, said body having a length along a generally horizontal axis when said hanger is suspended by said hanging means;

(b) said body comprising two substantially rigid extended body arms, each having a free end and a base, and each constituting a portion of said length of said body, said body arms connected one to another at their respective bases by a first hinge and a second hinge, so that said body arms may be folded together and positioned in side-by-side relation to decrease said length of said body, said first hinge connecting one of said body arms to a spacer and said second hinge connecting the other of said body arms to said spacer so as to permit a space to exist between said bases of said body arms when said body arms are folded together along both said hinges;

(c) said hanging means comprising a suspension member and a widened collar, said collar attached to the lower edge of one of said body arms along the edge of said collar opposite said suspension member, this attachment being via another hinge so that said suspension member and collar may be positioned in side-by-side relation to said body arms; and (d) latching means for securing said suspension member and collar to said hanger body when said suspension member and collar are in side-by-side relation to said body arms and said body arms are not in side-by-side relation with each other.

15. The hanger of claim 14 wherein each of said body arms have retaining means at its free end for securing garments.

* * * * *